United States Patent [19]

Winters et al.

[11] Patent Number: 5,012,877

[45] Date of Patent: May 7, 1991

[54] APPARATUS FOR DEFLECTING A DRILL STRING

[75] Inventors: Warren J. Winters; Michael B. Burton, both of Tulsa, Okla.

[73] Assignee: Amoco Corporation, Chicago, Ill.

[21] Appl. No.: 443,768

[22] Filed: Nov. 30, 1989

[51] Int. Cl.[5] ..... E21B 7/08

[52] U.S. Cl. ..... 175/80; 175/81; 175/83

[58] Field of Search ..... 175/61, 79, 80, 81, 175/82, 83, 78; 166/117.6

[56] References Cited

U.S. PATENT DOCUMENTS

| | | | |
|---|---|---|---|
| 1,806,509 | 5/1931 | Straatman | 175/79 X |
| 2,105,721 | 1/1938 | Cutrer et al. | 175/83 |
| 2,207,920 | 7/1940 | Hughes | 175/81 |
| 2,324,682 | 7/1943 | De Long | '75/81 |
| 2,669,430 | 2/1954 | Zublin | 175/82 X |
| 2,821,362 | 1/1958 | Hatcher | 175/82 X |
| 2,852,230 | 9/1958 | Garrison | 175/82 X |
| 2,882,015 | 4/1959 | Beck | 175/80 X |
| 4,007,797 | 2/1977 | Jeter | 175/81 X |
| 4,765,404 | 8/1988 | Bailey et al. | 166/117.6 |
| 4,790,384 | 12/1988 | Schellstede et al. | 175/79 X |
| 4,852,666 | 8/1989 | Bruner et al. | 175/80 X |

OTHER PUBLICATIONS

"Pack-Stock" sales brochure by A-Z International Tool Company.

Bailey, Thomas F. "The Pack-Stock: An Economic Method of Sidetracking Through a Cased Hole", *Drilex Technical Bulletin 8807.*

*Primary Examiner*—Hoang C. Dang

*Attorney, Agent, or Firm*—Scott H. Brown; Fred E. Hook

[57] ABSTRACT

Apparatus and method for deflecting the drilling direction of a rotary drill string and drill bit through a borehole wall include an anchor, a housing, and a chute. The anchor anchors the apparatus in the borehole. The housing is connectable to the anchor and has an uphole end, a downhole end, a sidewall extending between the uphole end and the downhole end, and a passageway extending through the housing. The passageway has an entrance through the uphole end of the housing and an exit through the sidewall of the housing. The chute is slidably disposed in the housing passageway and has an uphole end, a downhole end, a sidewall extending between the uphole end and the downhole end, and a passageway extending through the chute from the uphole end through the downhole end. The chute passageway passes the drill bit and drill string through the chute. The chute is movable between a retracted position in which the chute is retracted into the housing passageway and an extended position in which the chute is extended through the housing passageway exit to the borehole wall. The apparatus is inserted into a borehole and anchored, the chute is released to extend into contact with the borehole wall, and the drill bit and drill string are deflectingly passed through the chute.

3 Claims, 1 Drawing Sheet

APPARATUS FOR DEFLECTING A DRILL STRING

BACKGROUND OF THE INVENTION

1. Field of the Invention

This invention relates to apparatus and methods for steering subterranean drilling assemblies and more particularly, but not by way of limitation, to apparatus and methods for deflecting the drilling direction of a rotary drill string and drill bit into and through a borehole wall.

2. Setting of the Invention

In order to enhance the recovery of subterranean fluids, such as oil and gas, it is sometimes desirable to orient the direction of the well bore or borehole. In an oil producing formation or strata which has limited vertical depth and relatively greater horizontal extent with respect to the surface of the earth, a borehole which extends horizontally through the oil producing formation may be more productive than one extending vertically. In order to create an inclined, highly deviated or horizontal borehole, it is necessary to steer the drilling bit at the end of the drill string from a generally vertical orientation to a lateral or horizontal orientation.

In steering a drill bit and drill string from a vertical orientation to a horizontal or other non-vertical orientation, it is necessary to deflect or side track the drill bit from the generally vertical borehole to a drilling direction inclined to the wall of the borehole. This initial step is also known as "kicking off" the drill bit and drill string. It is typical to first drill a vertical borehole and then attempt to deflect the drill bit and drill string by some means thereby causing it to drill through the wall of the existing borehole.

When drilling a deviated wellbore from a cased well, one must first cut and remove a section of the casing. Once the casing is removed, an opening is provided for the drill bit to pass through and into the cement surrounding the casing and then out into the formation. Due to irregularities in the cementing process, the casing may not be centered within the wellbore; further, the cement may not fully surround the casing. Thus, the actual distance between the sectioned casing and the material to be drilled (i.e., cement and/or formation material) is not known.

The drilling assembly (drill bit and drill string) is usually very flexible so it is partially unsupported as it spans the gap and thus is difficult to control, particularly during the "kick off" activities when the drill bit is just starting to drill into the borehole wall. This lack of control often necessitates the time consuming additional step of drilling a short pilot hole with a more easily controlled, nonflexible drilling assembly prior to using the flexible drilling assembly.

Another problem with the prior whipstocks is that the maximum deflection of the drill bit from the axis of the borehole ("exit angle") is in the range of about four degrees or less. As a result of this limitation, the total footage required to attain a horizontal trajectory and the amount of borehole casing that must be removed are much larger than with a greater exit angle.

Another problem with the prior whipstocks is that there is considerable difficulty in retracting the skewed or curved drill string and drill bit from the skewed borehole because the shoulders and other abrupt surface-changes in the drill string and drill bit hang up on the whipstock as they are pulled across the gap.

Therefore, there is a need for an apparatus and method of deflecting the drilling direction of a rotary drill string and drill bit through a borehole wall which will support the drill bit and drill string throughout its transition from the generally vertical borehole into the borehole wall, which will reduce the axial length of casing which must be removed to allow deflection through the borehole wall, which will reduce the likelyhood of snagging when retracting the drill bit and drill string from the borehole wall, which will eliminate the need for drilling a pilot hole with a rigid drilling assembly prior to running the flexible drilling assembly, which will provide greater control of kick off direction and angle, and which will reduce the total drilling footage required to attain a horizontal or other desired nonvertical drilling trajectory. It is contemplated that such an apparatus and method will allow more accurate steering of subterranean drilling assemblies and result in higher production rates of oil and gas.

SUMMARY OF THE INVENTION

The present invention is contemplated to overcome the foregoing deficiencies and meet the above-described needs. For accomplishing this, the present invention provides a novel and improved apparatus and method for deflecting the drilling direction of rotary drill string and drill bit through a borehole wall.

The apparatus includes anchor means, a housing, and a chute. The anchor means is used for anchoring the apparatus in the borehole. The housing is connectable to the anchor and includes an uphole end, a downhole end, a sidewall extending between the uphole end and the downhole end, and a passageway extending through the housing. The housing passageway has an entrance through the uphole end of the housing and an exit through the sidewall of the housing. The chute is movably disposed in the housing passageway and includes an uphole end, a downhole end, a sidewall extending between the uphole end and the downhole end, and a passageway extending through the chute from the uphole end through the downhole end. The chute passageway passes the drill bit and drill string through the chute. The chute is movable between a retracted position in which the chute is retracted into the housing passageway and an extended position in which the chute is extended through the housing passageway exit to contact the borehole sidewall.

A first retention means is provided for releasably retaining the chute in the retracted position and for releasing the chute to move to the extended position. A second retention means is provided for releasably retaining the drill string to the chute and for releasing the drill string from the chute so that the drill bit and drill string are movable within the chute passageway. Preferably, the first retention means releases the chute before the second retention means releases the drill string. Preferably the first and second retention means are shear pins.

Orienting means are provided for determining the direction which the downhole end of the chute will extend in the extended position.

The method of deflecting the drilling direction of a rotary drill string and drill bit through a borehole wall includes anchoring a housing in the borehole; extending a chute from the housing to the borehole wall; passing the drill bit and drill string through the housing and chute; and deflecting the drill bit and drill string towards the borehole wall with the chute and supporting the portion of the drill bit and drill string extending between the housing and the borehole wall with the chute. The method further provides orienting the downhole end of the chute in the desired direction in the extended position of the chute.

In another embodiment, the method includes fastening a chute inside a housing; fastening the drill bit inside the chute; lowering the drill bit, chute, and housing into the borehole with the drill string; anchoring the housing in the borehole; releasing the chute from the housing and extending the chute from the housing to the borehole wall; releasing the drill bit from the chute and passing the drill bit and drill string through the chute and housing; and deflecting the drill bit and drill string into the borehole wall with the chute while supporting the portion of the drill bit and drill string extending between the housing and the borehole wall with the chute.

BRIEF DESCRIPTION OF THE DRAWINGS

The present invention will be better understood by reference to the example of the following drawing.

DETAILED DESCRIPTION OF THE PREFERRED EMBODIMENTS

Figure 1:
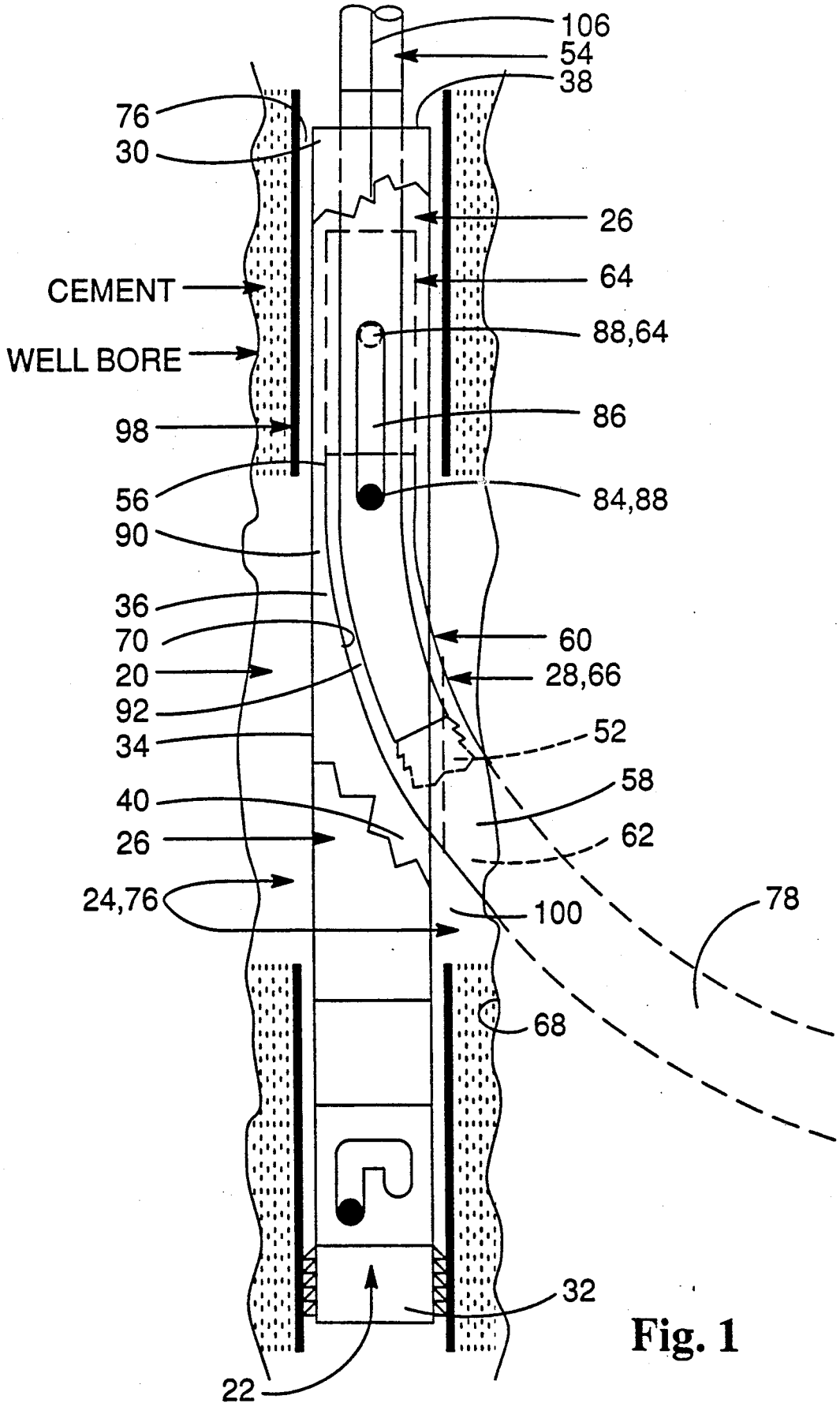
FIG. 1 is a partially cutaway, sectioned side view of an embodiment of the apparatus and method for deflecting the drilling direction of a rotary drill string and drill bit through a borehole wall.

FIG. 1 presents an embodiment of the apparatus and method, generally designated 20, for deflecting the drilling direction of a rotary drill string and drill bit through a borehole wall. As exemplified in FIG. 1, in the preferred embodiment, the method and apparatus 20 (hereinafter collectively referred to as "apparatus") is used in drilling an oil or gas well, although it is intended to be understood that the apparatus may be used with virtually any type of drilling apparatus in any type of environment, e.g., water wells, steam wells, etc.

Referring to the example of FIG. 1, the apparatus 20 of the present invention may be generally described as comprising anchor means 22 for anchoring the apparatus 20 in the casing wall or borehole 24, a housing 26, and a chute 28.

The housing 26 is connectable to the anchor means 22 and has an uphole end 30, a downhole end 32, a sidewall 34 extending between the uphole end 30 and the downhole end 32, and a passageway 36 extending through the housing 26. The passageway 36 has an entrance 38 through the uphole end 30 of the housing 26 and an exit 40 through the sidewall 34 of the housing 26. In the preferred embodiment, the entrance 38 extends axially through the uphole end 30 of the housing 26 and the exit 40 is in the circumference of the sidewall 34 of the housing 26.

The anchor means 22 may be an integral portion of the housing 26, as exemplified in FIG. 1 or the anchor means 22 may be attached to the housing 24 by suitable fastening, such as threading engagement, welding, etc. The housing 26 should be securely connected to the anchor means 22 so that any loading forces exerted on the housing 26 by the drill bit 52 and drill string 54 will be transferred through the anchor means 22 to the casing wall or subterranean formation whichever is surrounding the anchor means 22.

The housing 26 may take any shape or size which will movably or slidably house the chute 28. Preferably, the housing 30 is a tubular pipe-like member as is the chute 28. The housing 26 and chute 28 may be channel-shaped or open-sided, since it is not necessary that they sealingly contain fluid.

The chute 28 is slidably disposed in the housing passageway 36. The chute 28 has an uphole end 56, a downhole end 58, a sidewall 60 extending between the uphole end 56 and the downhole end 58, and a passageway 62 extending through the chute 28 from the uphole end 56 to the downhole end 58. The chute passageway 62 passes and guides the drill bit 52 and drill string 54 through the chute 28. The chute 28 is movable between a retracted position 64 in which the chute 28 is retracted into the housing passageway 36 and an extended position 66 in which the chute 28 is extended through the housing passageway exit 40 to the borehole wall 68.

The chute 28 guides the drill string 54 and drill bit 52 into contact with the borehole wall 68. The chute 28 and chute passageway 62 may slope linearly from the uphole end 56 to the downhole end 58 of the chute 28. In the preferred embodiment, as illustrated in FIG. 1, the chute 28 and chute passageway 62 are curved such that the downhole side 70 of the interior surface of the chute passageway 62 defines a concave curve in the extended position 66 of the chute 28. In the preferred embodiment, the chute 28 is a curved pipe-like member which mechanically guides the drill bit and drill string from a vertical orientation in the borehole 24 and deflects the drill bit 52 and drill string 54 into contact with the borehole wall 68. Normally, the deflected trajectory through the borehole wall 68 should pass through the uppermost side of the borehole wall 68 if the borehole 24 is not vertical, so that the plane defined by the radius of the arc of the chute 28 is a vertical plane. This orientation of the skewed trajectory allows the chute 28 to mechanically guide the drill bit 52 and drill string 54 into contact with the borehole wall 68, i.e., the chute 28 will be below the drill string 54 in the borehole 24 so that the downhole side 70 of the interior surface of the chute passageway 62 will continuously support and guide the deflected drill string 54.

As illustrated in FIG. 1, the outside diameter of the housing 26 is smaller than the inside diameter of the borehole 68 thereby creating a gap 76 between the housing 26 and borehole wall 68. The chute 28 extends across the gap 76 in order to support the drill bit 52 and drill string 54 as the drill bit 52 and drill string 54 are deflected and curved from the borehole 24 into the borehole wall 68 and the skewed bore 78. The chute 28 bridges the gap 76 between the housing 26 and the borehole wall 68 and prevents the drill bit 52 and flexible drill string 54 from drooping in the gap 76. The drill string 54 must be flexible in order to be deflected and to follow the skewed bore 78. The flexibility of the drill string 54 creates the potential for drooping and/or hanging up, i.e., the flexible joints in the drill string 54 create shoulders and other protuberances which may hang up on the edges of the borehole 24 and drilling equipment which are left exposed by the gap 76.

The chute 28 and chute passageway 62 cradle the drill bit 52 and drill string 54 and smoothly guide the drill bit 52 into contact with the borehole wall 68 and into the skewed bore 78. This cradling guidance of the drill bit 52 and drill string 54 control the point at which the drill bit 52 contacts the borehole wall 68 and direct the angle at which the drill bit 52 and drill string 54 contact the borehole wall 68 (commonly called the "exit angle," which is the angle between the axis of the borehole and the angle of the path defined by the deflected drill bit 52). The curvature of the chute creates a longer length of contact with the drill bit 52 and drill string 54 than would a linear deflecting device so that the drill bit 52 and drill string 54 are supportingly guided to exit the chute 28 at the same exit angle at the downhole end 56 of the chute 28. It is contemplated that the curved chute 28 will allow an exit angle of approximately thirteen to sixteen degrees, whereas conventional whipstocks provide no more than seven to nine degrees of exit angle. This higher or greater exit angle should improve control of the kick-off direction and will reduce the total footage required to attain the desired nonvertical trajectory of the skewed bore 78. The precise exit angle and limits on the range of exit angles possible with the apparatus 20 depend primarily upon the internal diameter of the housing passageway 36 and the outer diameter of the chute 26, which are in turn dependent upon the internal diameter of borehole 24 or casing 98 and the outer diameter of the drill string 54, respectively. Therefore, the range of exit angles possible with the apparatus 20 may be expanded beyond thirteen to sixteen degrees, although it is contemplated that the diameters of drill string and boreholes/casings in common use will limit the range of exit angles to approximately thirteen to sixteen degrees.

It is also contemplated that the higher exit angle of apparatus 20 will minimize the axial length and size of the opening 100 which must be milled in a cased borehole 24 since the higher exit angle will have a reduced length of axial intersection with the casing. It is advantageous to minimize the size of the opening 100 since milling the borehole casing 98 is normally a difficult operation due to the nature of casing, i.e., casing is normally installed to be a permanent part of a borehole and by its very nature it is difficult to remove by milling.

It is also contemplated that the extension of the chute 28 across the gap 76 will allow easier extraction of the drill bit 52 and drill string 54 from the skewed bore 78 as the chute 28 should prevent hang up of the drill bit 52 and drill string 54 in the gap. The chute 28 should be sized to have sufficient length to extend across the gap 76 into contact with the borehole wall 68. The guide means 84, particularly if the guide means 84 includes slots 86, must allow sufficient motion of the chute 28 for the chute 28 to extend across the gap 76 into contact with the borehole wall 68 and to retract within the housing passageway 36.

The apparatus 20 includes guide means 84 for guiding the chute 28 between the retracted position 64 and the extended position 66 and for preventing rotation of the chute 28 within the housing 26 about the longitudinal axis of the chute 28. The guide means 84 may be an inclined ramp within the housing 26 which guides the chute 28 or may be effected by the shape of the housing 26 or housing passageway 36, e.g., the housing passageway 36 may be curved, concentrically house, and restrict rotation of the chute 28.

In the preferred embodiment, as illustrated in FIG. 1, the guide means includes at least two slots 86 in one of the housing 26 and the chute 28 and at least two protuberances or pins 88 on the one of the housing 26 and chute 28 not having the slots 86. The protuberances 88 are slidably engaged in the slots 86 in order to guide the chute 28 between the retracted and extended positions 64, 66. Preferably, the protuberances 88 are in the outside surface of the chute 28 and the slots 86 are in the housing 26. Preferably, the slots 86 and 88 are on diametrically opposed sides of the housing 26 and the protuberances 88 are on diametrically opposed sides of the chute 28. The guide means 84 should be oriented on the housing 26 and chute 28 to both axially and radially guide the chute 28 to the borehole wall 68.

The axial and radial guidance of the chute 28 may be accomplished by curving or skewing the guide slots 86 towards the exit 40, by allowing the chute 28 to pivot about protuberances 88 and mechanically guiding the chute downhole end 58 through exit 40 with guide slots 86 and the edge of the exit 40 providing both longitudinal and circumferential support.

In the preferred embodiment, the apparatus 20 comprises first retention means 90 for releasably retaining the chute 28 in the retracted position 64 and for releasing the chute 28 to move to the extended position 66 when the housing 26 is anchored in the borehole 24. The preferred embodiment also includes second retention means 92 for releasably retaining the drill string 54 through the chute 28 and for releasing the drill string 54 from the chute 28 when the housing 26 is anchored in the borehole 24. Preferably, the first retention means 90 releases the chute 28 before the second retention means 92 releases the drill string 54, as further discussed below. In the preferred embodiment, the first retention means 90 is a chute shear pin, also designated 90, connected between the housing 26 and the chute 28. Similarly, the second retention means 92 is a string shear pin, also designated as 92, connected between the drill string 54 and the chute 28. The string shear pin 92 has greater resistance to shearing forces than the chute shear pin 90 so that the first shear pin 90 will release the chute 28 before the second shear pin 92 releases the drill string 54. The shear pins may be replaced with bonding, riveting, or equivalent releasable or breakable fastening.

The anchor means 22 may be any device capable of anchoring the apparatus 20 in the borehole 24. Such anchors, packers, and gripping elements are known in the industry. Preferably, the anchor means 22 is a releasable device which can be inserted into the borehole 24, anchored, and removed at a later, selected time. The apparatus 20 may be used in either an open borehole 24 or in a borehole having a casing 98 by selecting the proper type of anchor means 22 or packer. The anchor means 22 should prevent axial, radial and rotational motion of the housing 26 and apparatus 20 when anchored or secured in position in the borehole 24. If the anchor means 22 is a packer or packing-type device it may also be used to seal the borehole 24 below the anchor means 22.

If the borehole 24 includes a casing 98 lining the borehole wall 68, the casing 98 should have an opening 100 positioned to allow access to a selected area of the borehole wall 68. The opening 100 may be a window-like opening milled in one area or one side of the circumference of the casing 98 or may be effected by milling out an entire circumferential section of the casing 98, as exemplified in FIG. 1.

The apparatus 20 may also include orienting means 106 for determining the area on the circumference of the borehole wall 68 toward which the downhole end 58 of the chute 28 will extend in the extended position 66 of the chute 28. The orienting means 106 may be a line drawn on the circumference of the housing 26 and drill string 54 which extends to the surface where it may be observed by an operator; may be a magnetic surveying instrument, such as a wireline surveying instrument; or may be a gyroscopic survey tool; all of which are known methods of orienting drilling equipment in a subterranean borehole from a remote location, such as the surface of the earth. Normally the gyroscopic survey tools are used in cased boreholes since gyroscopic tools sense gravity and the casing may create inaccuracy in magnetic surveying instruments which sense the earth's magnetic field.

In operation, the apparatus 20 is anchored in a borehole 24 and the drill bit 52 and drill string 54 are passed through the chute passageway 62 which deflects the drill bit 52 into contact with the borehole wall 68. The skewed bore 78 may then be drilled as is known in the art. If a casing 98 is in the borehole 24 an opening 100 must be milled in the casing 98 before the apparatus 20 is used.

To explain the operation in greater detail, in the preferred embodiment, the first retention means 90 or chute shear pin is used to secure the chute 28 in the retracted position 64 within the housing passageway 36. The second retention means 92 or string shear pin is used to fasten the drill string 54 to the chute 28. The housing 26 is securely fastened to a suitable anchor means 22. The drill string 54 is used to lower the apparatus 20 into the borehole 24 to the desired depth. The orienting means 106 is then used to orient the downhole end 58 of the chute 28 so that the downhole end 58 of the chute 28 will extend through the opening 100 (if the borehole 24 has a casing 98) and in the desired direction. The drill string 54 is then manipulated in a manner necessary to anchor the anchor means 22, which typically involves rotating the drill string 54 and moving the drill string 54 axially to set the anchor means 22 and anchor the apparatus 20 in the borehole 24. The drill string 54 is then used to exert weight or compressive force on the apparatus 20 until the first retention means 90 or chute shear pin is sheared which frees the chute 28 and allows it to slide on guide means 84 into contact with the borehole wall 68. The drill string 54 is then used to shear the second retention means 92 which may be accomplished by exerting additional weight or compressive force on the drill string 54, or by rotating the drill string 54 to shear the second retention means 92 with rotational torque. Once the second retention means 92 has been sheared the drill string may be lowered until the drill bit is in contact with the borehole wall 68 and the skewed bore 78 may then be drilled. If the second retention means is to be sheared by the weight or compressive force of the drill string 54 the second retention means 92 should be positioned such that the drill bit 52 is not at the downhole end 58 of the chute 28, i.e., if the drill bit 52 is in contact with the borehole wall 68 before the second retention means 92 is sheared it may not be possible to apply sufficient weight to shear the second retention means 92.

Thus, only one trip of the drill string 54 and apparatus 20 into the borehole 24 is required to anchor the apparatus 20, orient the apparatus 20, extend the chute 28, and initiate and drill the skewed bore 78. The apparatus 20 may be removed using well known techniques such as running a retrieving tool (not illustrated) into the borehole 24, connecting the retrieving tool to the housing 26 or chute 28, and then manipulating the housing 26 to release the anchor means 22. It is contemplated that this will normally be accomplished by providing female threads in the chute uphole end 56 which can threadingly engage the retrieving tool.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the following claims.

What is claimed is:

1. Apparatus for deflecting the drilling direction of a rotary drill string and drill bit through a borehole wall, comprising:

anchor means, for anchoring the apparatus in the borehole;

a housing, connectable to the anchor means, the housing having an uphole end, a downhole end, a sidewall extending between the uphole end and the downhole end, and a passageway extending through the housing, the passageway having an entrance through the uphole end of the housing and an exit through the sidewall of the housing;

a chute, slidably disposed in the housing passageway, the chute having an uphole end, a downhole end, a sidewall extending between the uphole end and the downhole end, and a passageway extending through the chute from the uphole end through the downhole end for passing the drill bit and drill string through the chute; the chute being movable between a retracted position in which the chute is retracted into the housing passageway and an extended position in which the chute is extended through the housing passageway exit to the borehole wall; and first retention means for releasably retaining the chute in the retracted position and for releasing the chute to move to the extended position including a chute shear pin connected between the housing and the chute, and second retention means for releasably retaining the drill string to the chute and for releasing the drill string from the chute including a string shear pin connected between the drill string and the chute.

2. The apparatus of claim 1:

wherein the string shear pin has greater resistance to shearing forces than the chute shear pin.

3. Apparatus for deflecting the drilling direction of a rotary drill string and drill bit through a borehole wall, comprising:

anchor means, for anchoring the apparatus in the borehole;

a housing, connectable to the anchor means, the housing having uphole end, a downhole end, a sidewall extending between the uphole end and the downhole end, and a passageway extending through the housing, the passageway having an entrance through the uphole end of the housing an exit through the sidewall of the housing;

a chute, slidably disposed in the housing passageway, the chute having an uphole end, a downhole end, a sidewall extending between the uphole end and the downhole end, and a passageway extending through the chute from the uphole end through the downhole end for passing the drill bit and drill string through the chute; the chute being movable between a retracted position in which the chute is retracted into the housing passageway and an extended position in which the chute is extended through the housing passageway exit to the borehole wall;

first retention means for releasably retaining the chute in the retracted position and for releasing the chute to move to the extended position when the housing is anchored in the borehole, comprising a chute shear pin connected between the housing and the chute;

second retention means for releasably retaining the drill string to the chute and for releasing the drill string from the chute when the housing is anchored in the borehole comprising;

a string shear pin connected between the drill string and the chute; and wherein the first retention means releases the chute before the second retention means releases the drill string.

* * * * *